US005647156A

United States Patent [19]

Hull et al.

[11] Patent Number: 5,647,156

[45] Date of Patent: Jul. 15, 1997

[54] NAVIGATOR DISPLAY PLOTTER AND METHOD OF USE

[76] Inventors: Harold L. Hull, 401 Canyon Way #43, Sparks, Nev. 89434; William G. Burnett, 1826 Quail Run Rd., Reno, Nev. 89523

[21] Appl. No.: 488,605

[22] Filed: Jun. 8, 1995

[51] Int. Cl.[6] ..... G09F 3/18

[52] U.S. Cl. ..... 40/661; 40/904; 283/34

[58] Field of Search ..... 40/630, 638, 661, 40/771, 904; 434/130, 416, 430; 283/34

[56] References Cited

U.S. PATENT DOCUMENTS

| | | | |
|---|---|---|---|
| 2,294,276 | 8/1942 | Callinicos | 40/904 X |
| 2,791,040 | 5/1957 | Santorelli | 40/904 X |
| 3,328,899 | 7/1967 | Stewart | 40/904 X |
| 4,083,137 | 4/1978 | Rosmanith . | |
| 4,157,626 | 6/1979 | Bedinghaus . | |
| 4,745,695 | 5/1988 | Hetzer | 40/661 |
| 5,022,170 | 6/1991 | House . | |
| 5,099,594 | 3/1992 | Reas et al. | 40/597 X |

*Primary Examiner*—Brian K. Green

[57] ABSTRACT

Herein disclosed is a navigational aid which is an integrally formed, transparent, flexible plastic plotter having two erasable writing surfaces and further includes indicia pertinent to navigational information thereon. Furthermore, the plotter provides a pocket for receiving a document therein, such as a map, whereby allowing a navigator to evaluate pre-flight plans or current flight information and to draw or write such information on the writing surface, whereby, the navigator never need write on the document so as to eliminate cost of continuously replacing maps and further encourages pre-flight planning so as to provide a safe flight for the navigator as well as their passengers.

1 Claim, 2 Drawing Sheets

NAVIGATOR DISPLAY PLOTTER AND METHOD OF USE

FIELD OF THE INVENTION

This invention relates to navigational aids, but more particularly relates to a map or document display plotter having indicia pertinent to navigational information thereon which allows a navigator to position a document therein for pre-flight planning and or current flight plan calculating.

BACKGROUND OF THE INVENTION

It is well known that pilots and/or navigators must correctly and efficiently evaluate their pre-flight plans and/or current flight information as their lives and/or the lives of their passengers depend on the pilots accuracy and thorough planning. It is therefore desirous to provide a pilot and/or navigator with a new navigational aid specifically designed to improve and encourage pre-planning and/or current flight plan calculating. Nowhere in the prior art (known to the applicants) do they provide such a display means which is specifically designed for use by a navigator. However, several references have attempted to provide display means for various articles, such as maps, stamps, etc. and each of which include a transparent cover and/or overlay, such as U.S. Pat. No. 5,022,170, in which they teach a "WORK SURFACE INFORMATION DISPLAY PAD". The pad comprising a transparent cover over a base layer and a work surface, such as a work table or the like, as the bottom surface of the pad is textured so as to reduce slippage of the pad when on the work surface and the top surface of the pad is textured so as to provide a substitute work surface upon which to write or operate a computer mouse. A further attempt is disclosed in U.S. Pat. No. 4,157,626 in which they provide a "MAPS AND CHART HOLDER". The holder having on each of its end portions a container, with the containers being of a shape and size to accept and capture a continuous rolled document. The end containers allow the document to be rolled until the desired information is displayed upon a planar central region between the end containers. Still a further attempt is taught within U.S. Pat. No. 4,083,137 in which they provide a "DISPLAY SYSTEM ADAPTED FOR PHILATELIC MATERIALS". This display system substantially comprising an opaque base having an overlying transparent cover which is removably affixed to the base by adhesive. The base providing attachment zones for receiving philatelic materials such as stamps, while the transparent cover includes further related indicia, whereby, the base and cover in combination provide the display system.

Many devices, too numerous to mention, have been devised for holding a document which enables visual inspection of the document when the document is secured to the holding device. Springboards, clipboards and various variations thereof have been known to the prior art for a number of years. To further aid the protection of the document, some in the prior art have used a substantially transparent material to overlay the document while the document was secured to the springboard or clipboard. Others in the prior art have developed transparent containers for protecting the document while enabling visual inspection thereof. These containers have been made of rigid and flexible plastic materials with various types of closures for securing the document within the container.

For a number of reasons, the aforementioned containers have not found widespread use in the art. In general, these devices were constructed of a number of parts which required assembly to produce the container device. Finally, these prior art devices did not provide means for enabling the visual inspection of both sides of the document contained therein, nor even if the advantages inherent in each of the references were to be combined, the claims of the present invention would not be met.

SUMMARY OF THE INVENTION

The present invention is a unique navigator display plotter which allows for a navigator to evaluate their pre-flight plans and/or current flight information when a document (such as a map) is inserted within the plotter between two transparent writing surfaces, whereby revealing the map beneath the writing surface and therefore allowing the navigator to make notations on the writing surface without destroying the map.

Therefore, it is a primary object of the present invention to provide a new navigational aid for pilots and/or navigators.

A further object is to provide a uniquely shaped, integrally formed mapline display plotter.

Yet another object is to provide a display plotter which is made from a suitable material such as flexible transparent plastic.

Yet a further object is to provide a display plotter which includes an erasable writing surface on either the front portion and/or the back portion.

Yet another object is to provide a display plotter which is of a size and shape to be easily hand-held or hand friendly.

Another object is to provide a pocket and/or space within the plotter for receiving a document, such as a map.

Still another object is to enable a pilot or navigator to visually inspect either/or both sides of a document when the document is positioned within the plotter pocket or space.

A further object is to provide the plotter with an adjustable closure means such as a lip, which allows positioning of the document within the plotter pocket, yet holds the document in a secure manner.

Yet another object is to provide a colored strip of material having printed indicia relating to pilot/navigator information thereon and which may be permanently affixed to the plotter by glue or the like, or it may be embedded within a portion/portions of the plotter during its manufacture, as shown in the preferred embodiment. It is to be noted that due to the plotter being transparent, the color of the strip of material provides an enhanced visual background so as to allow the indicia thereon to be eye-catching.

Still another object is to provide the display plotter (if so desired) with means to removably attach a water soluble pen, such as by VELCRO or the like.

A further object is to provide a method of use, as will be further explained in detail in the following specifications.

A final object is to provide a display plotter which overcomes the aforementioned inadequacies of the prior art and provides an improved device and method which is a significant contribution to the advancement of the art.

DETAILED DESCRIPTION OF THE DRAWINGS

Figure 1:
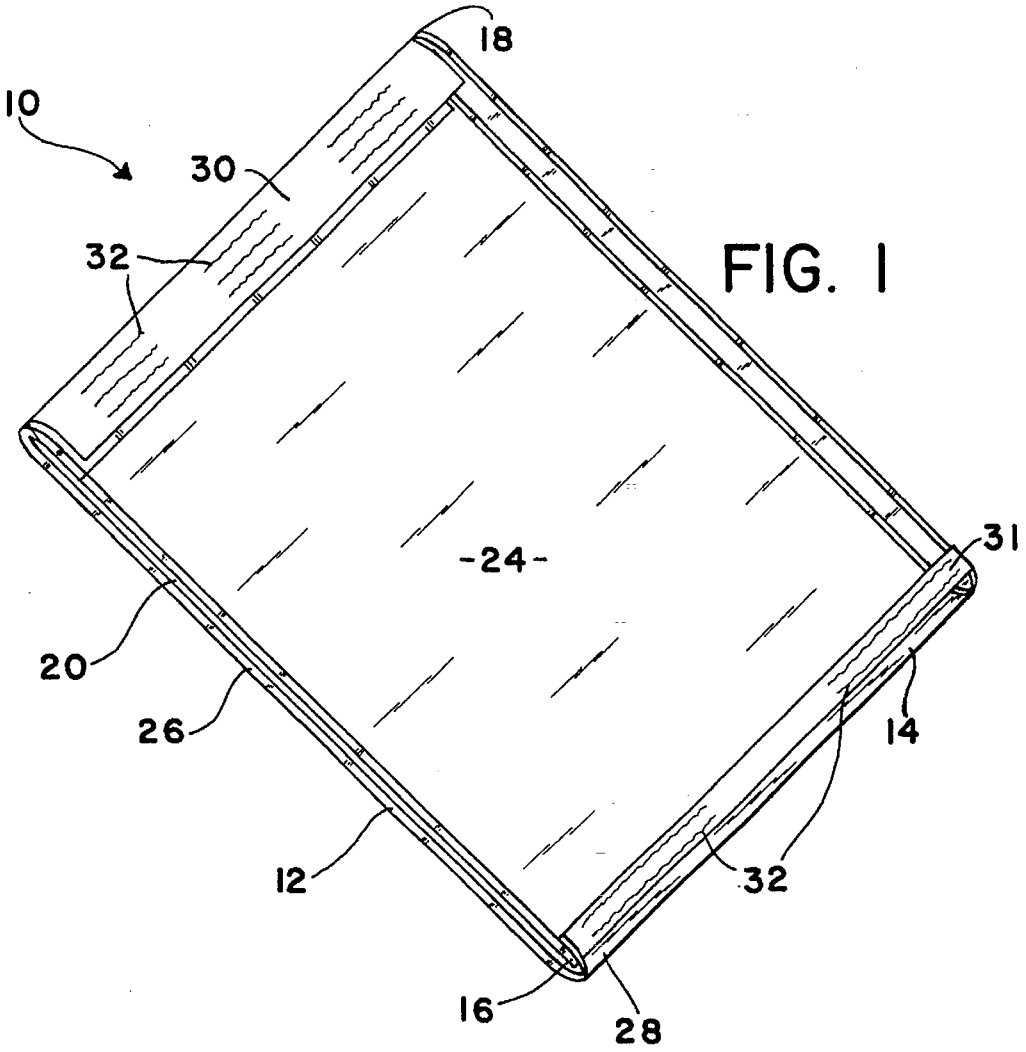
FIG. 1, is a perspective view.
Figure 2:
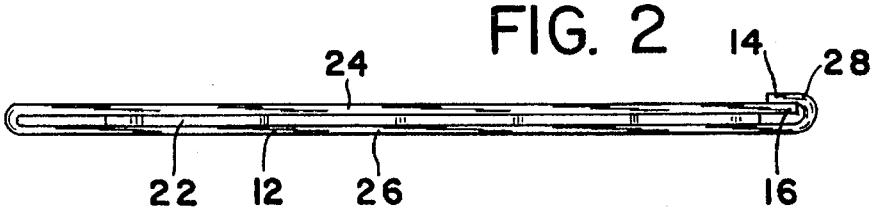
FIG. 2, is a side view showing a second closed position.
Figure 4:
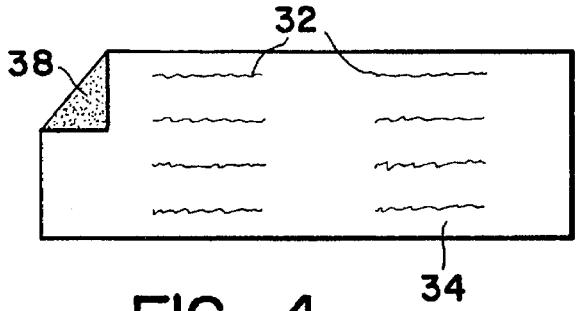
FIG. 4, is a front view of a piece of material having adhesive backing.
Figure 5:
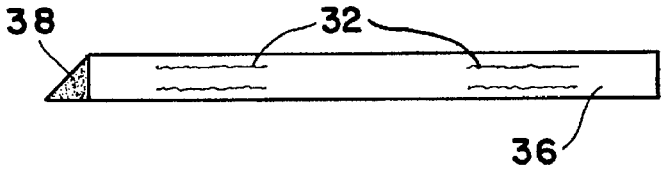
FIG. 5, is a front view of piece of material having adhesive backing.

Referring now in detail to the drawings wherein like characters refer to like elements throughout the various drawings. As shown in FIG. 1, 10 is an overview of a navigation display plotter which is made from any suitable material such as plastic and may be formed into any suitable shape such as circular, square, oval, rectangular, etc. Therefore, (as herein shown) the preferred embodiment provides an elongated, flexible, transparent, integrally formed plastic member 12 having a first end 14 and a second end 16. Member 12 being completely folded widthwise at substantially a semi-central portion 18 between ends 14 and 16, therefore forming a space 20. Space 20 is of a shape and size to accept a document 22 when positioned therein, such as a map, as shown in FIG. 2. Member 12 further providing a first and second exposed writing surface 24 and 26, each of which are erasable. The first end 14 is formed into a lip 28 which is of a shape and size to removably yet adjustably retain the second end 16 there within. Member 12 further includes at least one strip of material 30 having indicia 32 printed thereon which may be embedded during manufacture within the plotter or member 12 at a location of engineering choice, such as within the semi-central portion 18 of member 12. Member 12 may further include a second strip of material 31 embedded in member 12 at a location of engineering choice, such as within the first end 14, as shown in FIG. 1. Shown in FIGS. 4 and 5 we provide (as an alternative) a strip of material 34 and 36, each having means to be affixed to the plotter 12 at a location of engineering choice, such as by adhesive 38. Strips of material 30, 31, 34 and 36 also include indicia 32 which represents information pertinent to navigational information.

Figure 6:
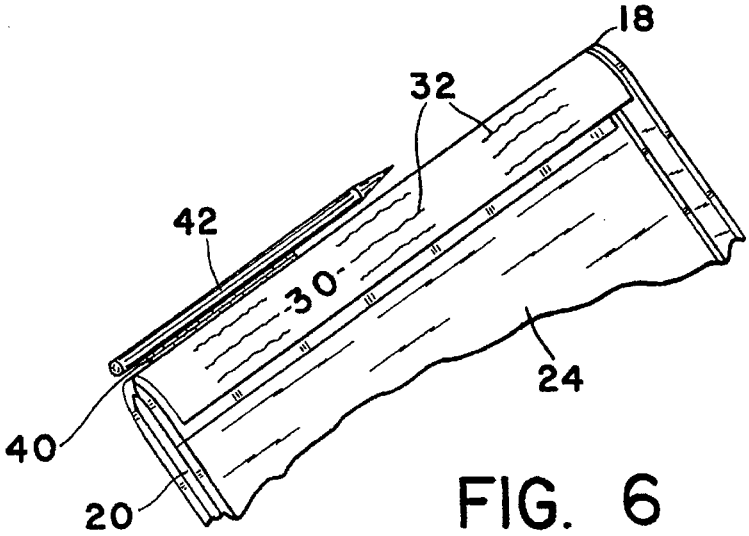
FIG. 6, is a front view showing a means to removably affix a writing instrument to the display plotter.

FIG. 6 shows a means to removably affix a writing instrument to member 12 at a location of engineering choice, (such as to semi-central portion 18) which is affixed such as by tape, a coiled cord or as herein shown, a loop and pile fastener, namely, VELCRO 40, with the writing instrument being a water soluble marker pen 42.

Figure 3:
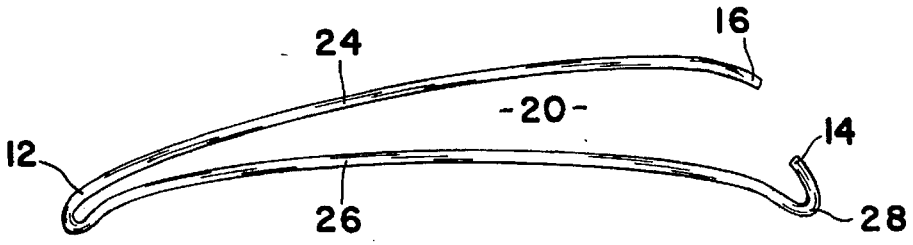
FIG. 3, is a side view showing a first open position.

It is to be noted that member 12 includes a first open position (as shown in FIG. 3) and a second closed position (as shown in FIG. 2).

It is to be further noted that we include a method of use for plotting a navigational course using a display apparatus, with the apparatus having a cover, a space, indicia and a closure means, with the cover being transparent, flexible, movable from a first open position and a second closed position and further provides a writing surface which is erasable and the space being of a shape and size to accept a document therein. The method comprising the steps of;

1. flexing said cover into said first open position, whereby releasing said closure means;
2. positioning the document within the space;
3. deflexing the cover into the second closed position, whereby closing the closure means;
4. drawing said navigational course on the writing surface;
5. entering data on the cover pertinent to the indicia;
6. initiating the navigational course;
7. completing the navigational course;
8. flexing the cover into the first open position whereby releasing the closure means;
9. removing the document from within the space and,
10. deflexing the cover into the second closed position, whereby closing the closure means.

It will now be seen that we have provided a transparent integrally formed navigational aid or plotter having indicia pertinent to navigational information thereon which allows a navigator to determine and evaluate their pre-flight plans and/or current flight information.

It will further be seen that we have provided a plotter which includes an integrally formed transparent overlay having two erasable writing surfaces and therefore allows a navigator to draw their flight plan or like information on either writing surface until this information and/or corrections are no longer desired, after which, the information may then be erased and/or deleted, whereby, the navigator no longer needs to mark-up and/or destroy the map, which can become very costly to continuously replace.

It will also be seen that we have provided a display plotter which may include means to removably affix a writing instrument thereto.

It will also be seen that we have provided a display plotter having a first and second position which allows a navigator to position and adjustably secure a document therein.

It will further be seen that we have provided a display plotter which is economical and easily manufactured.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by letters patent is:

1. A method of plotting a navigational course comprising the steps of;

providing a display apparatus having an elongated flexible transparent integrally formed plastic member having first and second ends;

folding said plastic member in order to form an upper cover member and a lower member, a space being formed between the cover member and the lower member, the cover member and lower member having exposed writing and erasable surfaces, the first end being formed into a lip which removably retains the cover member in a first position;

placing indicia on the display apparatus;

flexing the cover member in order to release the cover member from the lip;

positioning a document within the space; de-flecting the cover member in order to place the cover member under the lip to retain the cover member in the first position;

drawing a navigational course on one of the writing surfaces;

entering data on the cover member pertinent to the indicia on the display apparatus;

initiating a navigational course;

completing the navigational course;

flexing the cover member in order to release the cover member from the lip;

removing the document from within the space; and de-flexing the cover member into the first position.

* * * * *